United States Patent [19]

Ueno et al.

[11] 4,126,846

[45] Nov. 21, 1978

[54] VARIABLE RESISTOR

[75] Inventors: Teietsu Ueno; Kazuo Sato; Kohji Sugawara; Shuji Takamura; Masami Tanaka; Yukihiko Nomura; Isao Tsujioka, all of Tohda, Japan

[73] Assignee: Alps Electric Co., Ltd., Japan

[21] Appl. No.: 824,096

[22] Filed: Aug. 12, 1977

[30] Foreign Application Priority Data

Aug. 12, 1976 [JP] Japan ..... 51-107966[U]

[51] Int. Cl.[2] ..... H01C 1/02

[52] U.S. Cl. ..... 338/184; 338/176; 338/180; 338/199

[58] Field of Search ..... 338/160, 161, 164, 165, 338/176, 184, 199

[56] References Cited

U.S. PATENT DOCUMENTS

| | | | |
|---|---|---|---|
| 2,242,327 | 5/1941 | Rubinstein | 338/184 X |
| 2,935,715 | 5/1960 | Bourns et al. | 338/180 |
| 3,622,934 | 11/1971 | Yano et al. | 338/198 |
| 3,639,880 | 2/1972 | Oka | 338/183 |
| 3,671,915 | 6/1972 | Sasaki et al. | 338/183 |
| 4,047,146 | 9/1977 | Takeyama | 338/184 X |

*Primary Examiner*—C. L. Albritton

*Attorney, Agent, or Firm*—Guy W. Shoup; Gerard F. Dunne

[57] ABSTRACT

A variable resistor constructed from a minimum of parts, includes a housing having longitudinal grooves adapted to retain a base plate carrying a resistance element. The base plate can be inserted in one end of the grooves and slid forwardly until its leading edge abuts a stop on the housing. Latching portions carried by the housing and spaced rearwardly from the stop, engage behind step portions on the base plate to prevent it from sliding rearwardly from the housing.

6 Claims, 8 Drawing Figures

VARIABLE RESISTOR

This invention relates to a variable resistor, and more particularly, to a variable resistor which is constructed from a minimum number of parts and can be readily assembled.

DESCRIPTION OF THE PRIOR ART

As shown in FIGS. 1 and 2, a conventional screw-driving type of variable resistor includes a screw shaft 2 suspended within an insulating housing 1 which is open at the bottom side thereof, and an insulating base plate 4 which carries a resistance element 5. A slide 3 is moveable over the resistance element by turning the screw shaft 2. A variable resistor of this type is assembled by accommodating the screw shaft 2 and the slide 3 within the housing 1, covering the open side of the housing with a mounting plate 6 carrying the base plate 4, locking a plurality of mounting legs 6*a* and 6*a* of the mounting plate to the sides of the housing, and finally fixing, for example by calking, the base plate 4 to the housing. A terminal 7 leads to the screw shaft 2, and terminals 8 and 8' lead respectively to the ends of the resistance element.

As understood from the foregoing, the conventional structure requires, in addition to a lot of parts, the mounting plate 6 which is used for fixing the base plate to the housing, and time-consuming work is needed for locking the plurality of the mounting legs 6*a* and 6*a* of the mounting plate to the sides of the housing, and finally fixing the base plate 4 to the housing. Consequently, the production cost is rather expensive.

It is therefore an object of this invention to provide an improved construction of a variable resistor without having the disadvantages and defects mentioned above.

SUMMARY OF THE INVENTION

The variable resistor of the present invention is similar to known variable resistors in that it includes an insulating base plate having a resistance element thereon, means including a moveable element engaging the resistance element for varying the resistance between input and output terminals of the resistor and a housing secured to the base plate.

According to the invention, the housing includes opposing side walls which each have a longitudinal groove extending along a lower portion thereof and a forward end portion having a stop in the same plane as the grooves. The housing further includes latching portions spaced rearwardly from the stop. Preferably, the grooves extend to forward ends each spaced rearwardly of the latching portions and the latching portions are projections having the rear surfaces thereof angled rearwardly and upwardly to provide a camming surface over which the base plate can ride. The base plate has rearwardly facing step portions spaced back from a leading end of the base plate and adapted to be engaged by the latching portions. Therefore, the housing and base plate can be secured together simply by inserting the leading end of the base plate, which end may be tapered into the rearward end of the grooves and sliding the base plate forwardly until the leading edge abuts the stop and the step portions are engaged by the latching portions. The base plate may also have a notch extending rearwardly from the leading edge to provide two leg portions of the base plate. These leg portions are adapted to straddle a terminal leading to the moveable element, and a tongue extends from the stop and is adapted to fit within the notch.

BRIEF DESCRIPTION OF THE DRAWINGS

The above-mentioned and other features and objects of the present invention will become more apparent by reference to the following descriptions taken in conjunction with the accompanying drawings, wherein like reference numerals refer to like structures and in which.

DESCRIPTION OF THE PREFERRED EMBODIMENTS

Figure 1:
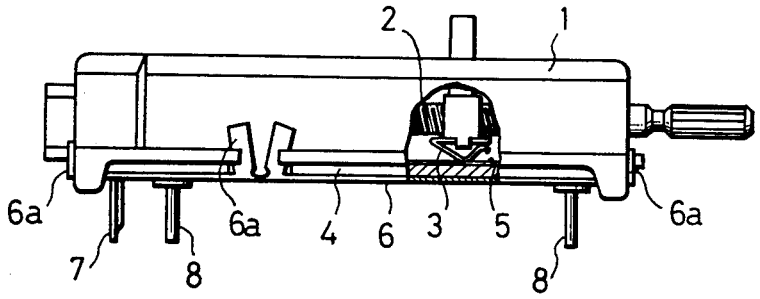
Fig. 1 PRIOR ART
FIG. 1 shows a partly-sectioned side view of a conventional variable resistor.
Figure 2:
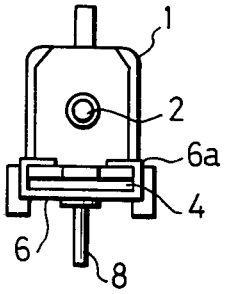
Fig. 2 PRIOR ART
FIG. 2 shows a front view of the variable resistor of FIG. 1.
Figure 3:
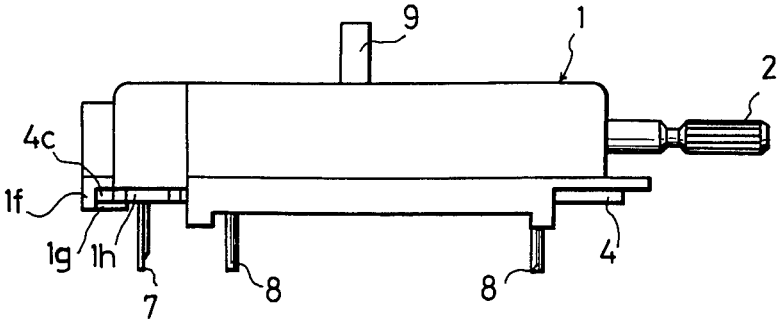
FIG. 3 shows a side view of a variable resistor in accordance with the present invention.
Figure 4:
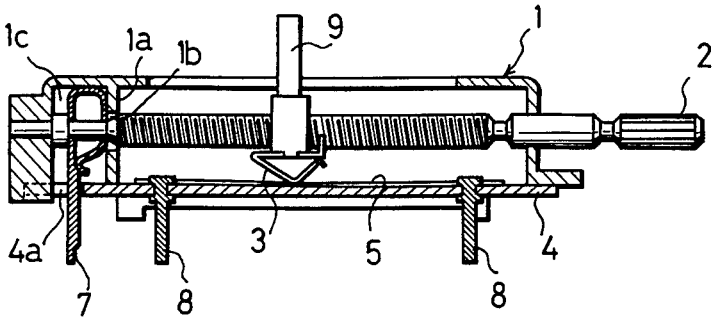
FIG. 4 shows a sectional side view of FIG. 3.
Figure 5:
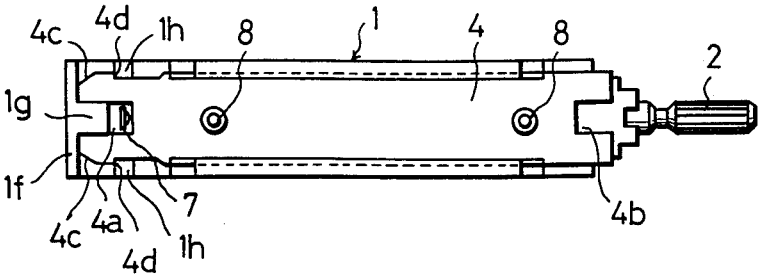
FIG. 5 shows a bottom view of FIG. 3.
Figure 6:
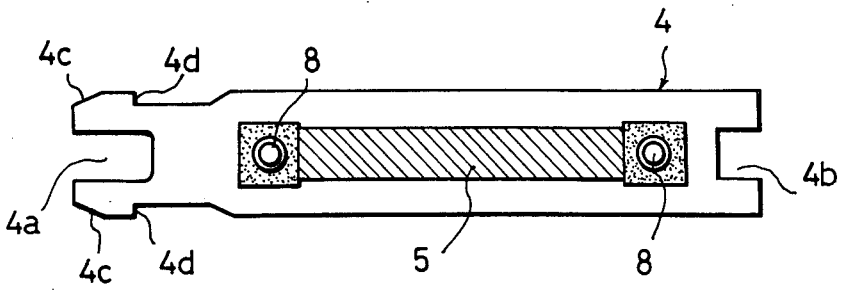
FIG. 6 shows an enlarged top view of the insulating base plate of the present invention.

As illustrated in FIGS. 3–5, a variable resistor according to the present invention includes an insulating housing 1 open at its bottom side and within which is provided a partition plate 1*a* having a hole 1*b* formed integrally therethrough. A screw shaft 2 made of metal or other suitable material is suspended within the housing by way of the hole 1*b*, and a moveable element or slide 3 is carried by the screw shaft 2. An insulating base plate 4 is mounted on the open side of the housing 1. Situated on the base plate 4 is a resistance element 5. In addition, an indicator 9 is attached to the slide 3 and used to indicate outside the housing the position of the slide. A terminal 7 leads electrically to the screw shaft 2 and is housed in a small chamber 1*c* partitioned off by means of the partition plate 1*a*, and terminals 8 and 8' lead respectively to the ends of the resistance element 5. Notches 4*a* and 4*b* are provided at respective ends of the base plate, as clearly illustrated in FIG. 6. A forward or leading end of the base plate 4 is tapered off as shown at 4*c*, 4*c*, and step portions 4*d* are formed at the sides of the base plate.

Figure 7:
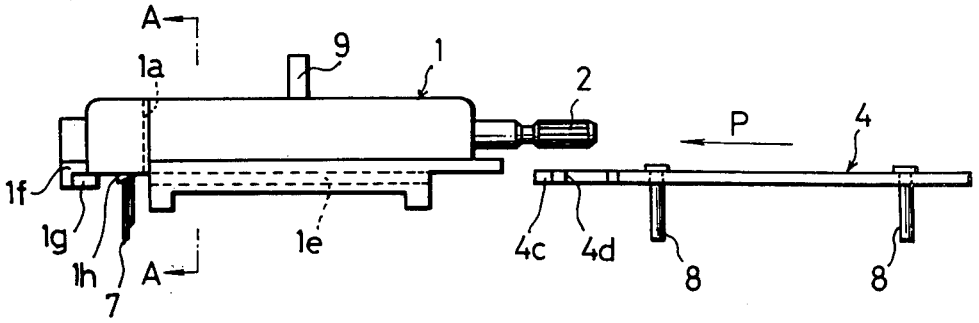
FIG. 7 is a drawing used for explaining the mounting of the insulating base plate to a housing.
Figure 8:
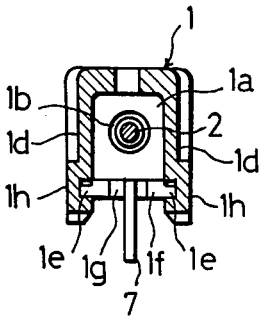
FIG. 8 shows an enlarged sectional view taken along line A—A of FIG. 7.

The screw shaft 2, slide 3, terminal 7 and other elements are mounted to the housing according to a conventional method. Referring now to FIGS. 7 and 8, the mounting of the insulating base plate 4 to the housing will be explained in detail.

Grooves 1*e* are formed in the opposing walls 1*d* of the housing and face each other. The grooves 1*e* extend longitudinally of the housing until they reach the partition 1*a*. Provided on the same plane as the grooves and at one end of the housing are a stop 1*f*, tongue 1*g*, and latching portions 1*h*, 1*h* (note also FIG. 5). The latching portions are spaced rearwardly of the stop 1*f* and comprise projections having their rear surfaces angled rearwardly and upwardly as shown most clearly in FIG. 7. The base plate 4 can be assembled to the housing simply be inserting its leading end into the grooves 1*e* in the direction indicated by the arrow P. The base plate is slid forwardly whereupon the tapered portions 4*c*, 4*c* of the base plate engage the rear surface of the latching portions and ride thereover until the step portions pass the latching portions, whereupon the leading end snaps into place. The notch 4*a* permits leg portions 4*e*, 4*e* to straddle the terminal 7. The tongue 1*g* fits within the notch 4*a* and the leading end of the base plate 4 abuts on the stop 1*f*. At the same time, the latching portions 1*h*, 1*h* lie behind the step portions 4*d*, 4*d*. Thus the base plate 4 is secured to the housing and prevented from coming out of the place.

As explained above, since the variable resistor according to the present invention is characterized by the formation of longitudinal grooves 1*e* on the side walls 1*d* of the housing, stop 1*f* at a forward portion of the housing as well as latching portions 1*h*, and step portions 4*d* on the base plate 4 having the resistance element 5, and in that when the base plate 4 is inserted into the grooves 1*e* and slid forwardly, the leading end of the base plate abuts on the stop 1*f* and the step portions 4*d* are latched by the latching portions 1*h*, the movement of the base plate 4 fore and aft is blocked by means of the stop 1*f* and the latching portions 1*h*, and at the same time, the falling-off of the base plate 4 from the housing is also prevented by means of the grooves 1*e*. The reliable attachment of the base plate 4 to the housing can thus be made by merely inserting it into the grooves 1*e* and sliding it forwardly. Accordingly, the mounting plate 6 which is normally used in conventional variable resistors becomes unnecessary, and the troublesome calking work can also be omitted. Consequently, the present invention exhibits outstanding features that can provide a new variable resistor which is simple in its assembling work and inexpensive in production cost.

This invention having been described in its preferred embodiment, it is clear that it is susceptible to numerous modifications within the ability of those skilled in the arts and without the exercise of the inventive faculty.

What is claimed is:

1. In a variable resistor comprising an insulating base plate having a resistance element thereon, means including a moveable element engaging said resistance element for varying the resistance between input and output terminals of the resistor and a housing secured to said base plate, the improvement wherein said housing includes opposing side walls each having a longitudinal groove extending along a lower portion thereof, a forward end portion having a stop in the same plane as said groove and latching portions space rearwardly from said stop, and said base plate having rearwardly facing step portions spaced back from a leading end of the base plate and adapted to engaged by said latching portions whereby the base plate and housing can be secured together simply by inserting the leading end of said base plate into the rearward ends of said grooves and sliding the base plate forwardly until said leading end abuts said stop and said step portions are engaged by said latching portions.

2. A variable resistor according to claim 1, said base plate tapering to said leadin edge.

3. A variable resistor according to claim 1, said latching portions being projections having the rear surfaces thereof angled rearwardly and upwardly to provide a camming surface over which said base plate can ride.

4. A variable resistor according to claim 1, said grooves extending to forward ends each spaced rearwardly from said latching portions.

5. A variable resistor according to claim 1, said grooves extending to forward ends each spaced rearwardly from said latching portions, and said latching portions being projections having the rear surfaces thereof angled rearwardly and upwardly to provide a camming surface over which said leading edge can ride after it exits said grooves.

6. A variable resistor according to claim 1, said base plate having a notch extending rearwardly from said leading edge to provide two leg portions of said base plate, said leg portions being adapted to straddle a terminal leading to said moveable element, and a tongue extending from said stop and adapted to fit within said notch.

* * * * *